US007073632B2

(12) United States Patent
Martin

(10) Patent No.: US 7,073,632 B2
(45) Date of Patent: Jul. 11, 2006

(54) SAFETY SYSTEM FOR RESTRAINING MOVEMENT OF ELEVATOR CAR WHEN CAR DOORS ARE OPEN

(75) Inventor: Matthew Martin, Randolph, NJ (US)

(73) Assignee: Invento AG, Hergiswil NW (CH)

( * ) Notice: Subject to any disclaimer, the term of this patent is extended or adjusted under 35 U.S.C. 154(b) by 448 days.

(21) Appl. No.: 10/447,028

(22) Filed: May 27, 2003

(65) Prior Publication Data

US 2004/0238289 A1 Dec. 2, 2004

(51) Int. Cl.
*B66B 1/32* (2006.01)

(52) U.S. Cl. ..... 187/288; 187/305; 187/350; 187/373; 188/188

(58) Field of Classification Search ..... 187/287, 187/288, 305, 350, 351, 373; 188/188, 189
See application file for complete search history.

(56) References Cited

U.S. PATENT DOCUMENTS

| | | | | |
|---|---|---|---|---|
| 1,635,265 | A * | 7/1927 | Darby | 187/323 |
| 4,556,155 | A | 12/1985 | Koppensteiner | |
| 4,662,481 | A * | 5/1987 | Morris et al. | 187/373 |
| 5,052,523 | A * | 10/1991 | Ericson | 187/350 |
| 5,065,845 | A * | 11/1991 | Pearson | 187/376 |
| 5,321,216 | A | 6/1994 | Jamieson et al. | |
| 5,323,877 | A * | 6/1994 | Mori | 187/375 |
| 5,377,786 | A * | 1/1995 | Nakagawa | 187/287 |
| 5,628,385 | A * | 5/1997 | Yumura et al. | 187/373 |
| 5,773,771 | A | 6/1998 | Chatham | |
| 6,003,636 | A * | 12/1999 | Yumura | 187/376 |
| 6,173,813 | B1 * | 1/2001 | Rebillard et al. | 187/288 |
| 6,202,795 | B1 * | 3/2001 | Bluteau | 187/288 |
| 6,296,080 | B1 * | 10/2001 | Draper et al. | 188/188 |
| 6,318,507 | B1 * | 11/2001 | Jin | 187/376 |

FOREIGN PATENT DOCUMENTS

| | | |
|---|---|---|
| EP | 0081212 | 6/1983 |
| FR | 2808517 | 11/2001 |
| WO | WO 200183353 A1 * | 11/2001 |

* cited by examiner

*Primary Examiner*—Emmanuel M Marcelo
(74) *Attorney, Agent, or Firm*—Butzel Long

(57) ABSTRACT

A safety system for an elevator car which will prevent movement of the elevator car should the car drift beyond a predetermined distance from the hoistway sill with the car door in an open position.

13 Claims, 1 Drawing Sheet

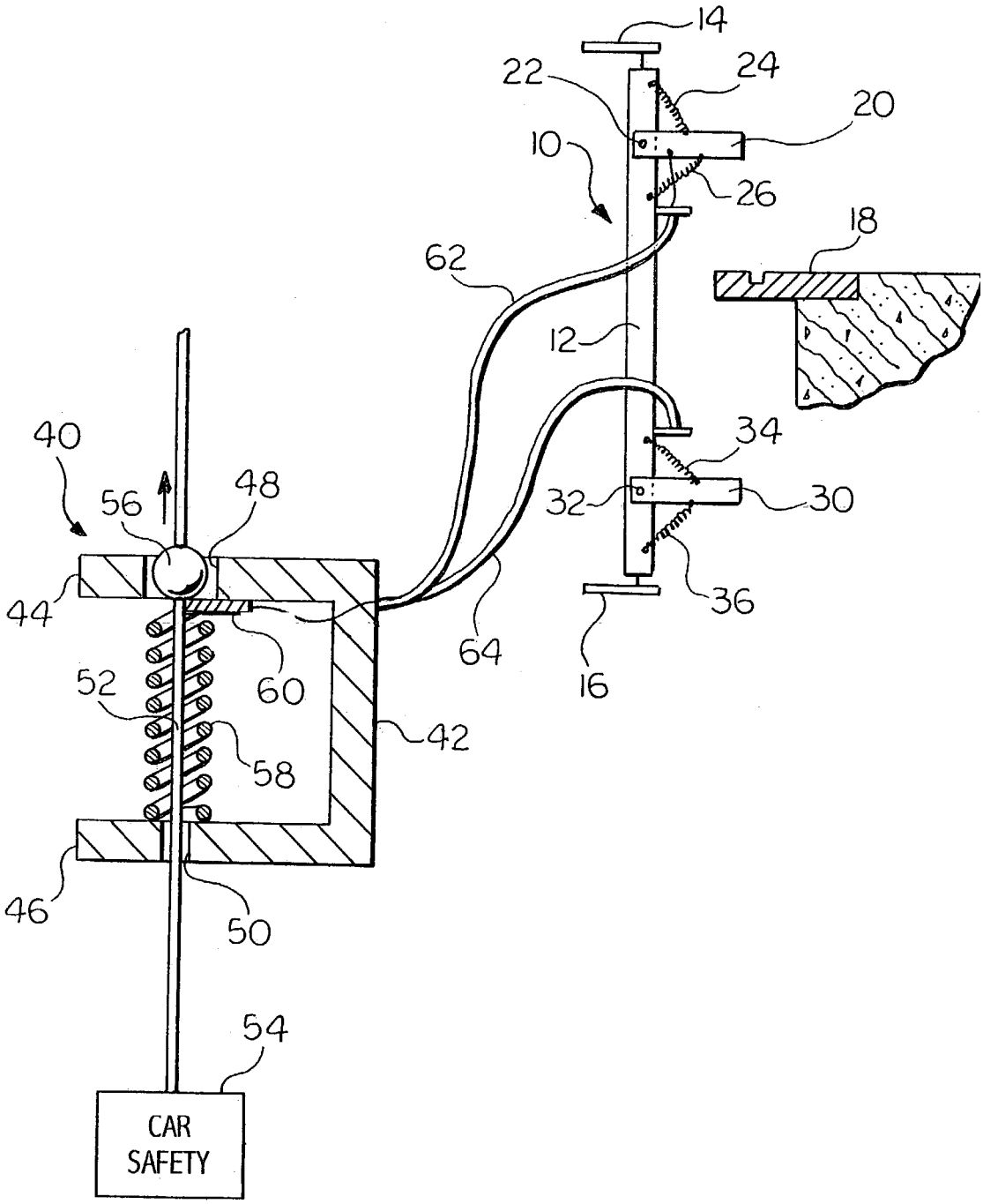
14
22
24
20
10
26
18
62
12
40
34
56
48
32
30
44
36
64
16
52
60
42
58
46
50
54
CAR
SAFETY

SAFETY SYSTEM FOR RESTRAINING MOVEMENT OF ELEVATOR CAR WHEN CAR DOORS ARE OPEN

BACKGROUND OF THE INVENTION

1. Field of the Invention

The present invention relates to an elevator car safety device. More particularly, the invention relates to an elevator car safety system which is operative to restrain movement of the car when the car doors are open.

2. Description of the Prior Art

Elevator systems of the prior art typically include an elevator car connected to a counterweight by means of a steel cable which is adapted to extend over a sheave located in the machine room located at the top of an associated elevator shaft. The sheave is connected to a hoist motor provided to effect vertical movement of the elevator car in the elevator shaft.

The hoist motor, provided with a brake, is connected to the sheave to control the rotation of the sheave and thus the vertical motion imparted to the elevator car. The brake is directly connected to the sheave and is employed to hold the elevator car in a stationary position.

The system further includes a safety governor which includes a governor rope which passes over a safety governor pulley located in the machine room and then extends downwardly to a tensioning pulley located at the bottom of the elevator shaft and then extends back to the governor pulley. The governor rope is typically connected to a progressive safety mounted in the elevator car. The safety governor is adapted to detect an overspeed condition of the elevator car based upon a ratio of the rotational velocity of the governor pulley proportional to the speed of the elevator car.

Safety governors are known in the prior art such as the governor illustrated and described in U.S. Pat. No. 4,556,155. The governor is provided with two diametrically opposed flyweights disposed on the governor pulley. In operation, as the elevator car travels up and down the elevator shaft, the flyweights move outwardly due to the centrifugal force imparted thereon by the rotating governor pulley.

When the speed of the elevator car exceeds a rated speed by a predetermined value, the flyweights are driven outwardly and are caused to trip an overspeed switch which cuts off power to the drive motor and simultaneously sets the brake.

In the event the elevator car speed continues to increase, the further outward motion of the flyweights causes the flyweights to contact and trip a mechanical latching device, releasing a swinging jaw which is normally held away from the governor rope. When the swinging jaw is released, it clamps the governor rope against a fixed jaw, thereby retarding governor rope motion. The retarding action exerted on the governor rope causes safeties located on the elevator car to engage, thereby progressively decelerating and ultimately arresting the motion of the elevator car.

There are a number of safeties known in the prior art, such as, for example, a safety having a roller located between the elevator car guide rail and a leaf spring. The leaf spring and the guide rail form a triangular section with the roller located at the base of the triangular section during normal operation.

The force exerted on the governor rope causes a safety gear linkage to lift the roller into the tapered portion of the triangular section. The leaf spring exerts pressure on the guide rail by way of the roller, and the pressure is progressively increased as the roller moves into the tapered portion of the triangular section. The executed pressure gradually decelerates and ultimately arrests the motion of the elevator car.

In operation, an elevator car is dispatched to a floor in response to a hall call and/or a car call. For the sake of efficiency, it is desirable to have the elevator car door begin to open prior to the car coming to a complete stop at the floor landing. Safety codes permit the elevator car door to commence opening prior to the elevator car coming to a complete stop. The codes permit such operation if the elevator car is within a predetermined zone, commonly referred to as an outer door zone, and a further proviso that the elevator car is travelling below a predetermined speed. The outer door zone is typically defined as a zone twenty-four (24) inches centered about the floor landing.

The arriving elevator car decelerates and, upon reaching the outer door zone, commences opening the car door. The elevator car will hover at the landing until it is level with the landing. When the elevator car is properly positioned at the landing, the brake is set and the drive motor is de-energized. In the event the elevator car should drift from the landing, the drive motor is caused to be re-energized to cause the car to be moved to the proper landing level.

Normally, an engaged drive and a set brake are each capable of holding the elevator car at the landing and/or stationary. However, in the event the drive or the brake should malfunction, the elevator car can drift away from the landing.

Other approaches to solve the problem include the use of electronic circuitry to monitor the speed of the elevator car, the position of the elevator car, and the state of the elevator car door. Once these parameters are within a certain predetermined range, a rope or cable brake is activated or an independent machine brake is activated.

Safety codes are being promulgated to require that a drifting elevator car should be stopped should the elevator car drift more than twenty (20) inches from a landing with the door in an open position. More specifically, the codes provide that if an elevator car drifts more than twenty (20) inches from a landing with the door open, the elevator car must be brought to a complete stop within another thirty (30) inches.

It is an object of the present invention to produce a safety system which will prevent further movement of the elevator car should the car drift beyond a predetermined distance with the door in an open position.

SUMMARY OF THE INVENTION

The above object of the invention may be typically achieved by a safety system for selectively restraining movement of an elevator car comprising an elevator car including door means for providing access to the interior of the car; a safety for selectively restraining the movement of the car; a rope connected to the safety; a stop secured to the rope; a helical compression spring disposed about the rope and adapted to act against the stop; a latch normally maintaining the spring under compression; and a latch actuating means mounted on the car for actuating the latch to cause the spring to urge the stop and the rope in a direction to actuate the safety and restrain movement of the car.

BRIEF DESCRIPTION OF THE DRAWING

The above object and advantages of the invention will become readily apparent to those skilled in the art from reading the following detailed description of a preferred embodiment of the invention when considered in the light of the accompanying drawings, in which:

There is a schematic illustration of a safety system for selectively restraining movement of an elevator car when the elevator door is open embodying the features of the invention.

DETAILED DESCRIPTION OF THE PREFERRED EMBODIMENT

Referring to the drawing, there is illustrated in schematic form a safety system for restraining movement of the elevator car when the elevator car door is open.

The system includes linkage between the elevator car door and an associated safety. The system more particularly comprises a bi-directional latch actuating mechanism 10 mounted on the elevator car. The mechanism 10 includes a generally vertically disposed bar 12 having the opposite ends thereof pivotally supported by a pair of vertically spaced apart supports 14 and 16. The supports 14 and 16 are mounted to the elevator car (not shown) and are adapted to extend in parallel relation to one another from the elevator car in a direction toward an associated hall floor threshold or hoistway sill 18. It will be understood, as the description unfolds, that the floor threshold 18 becomes the referencing structure that will cause the actuation of the inventive system should the elevator car be in the vicinity of the threshold with the doors open and move in either an up or down more than a predetermined prescribed distance. While the floor threshold may be regarded as the most appropriate actuating member, other members could be utilized such as, for example, a bracket affixed to and extending outwardly from an adjacent guide rail.

The mechanism 10 further includes a pair of spaced apart arms 20 and 30 which are pivotally attached to the bar 12. The arm 20 is attached to the bar 12 by a pivot 22, while the arm 30 is attached to the bar 12 by a pivot 32. The pivots 22 and 32 permit the respective arms 20 and 30 to pivot about a horizontal axis or an axis which is normal to the longitudinal axis of the bar 12. Each of the bars 20 and 30 is held in a neutral position, as illustrated by a set of counteracting springs 24, 26, and 34, 36, respectively.

Bar 12 is mounted to move the arms 20 and 30 to the position illustrated when the elevator car door is open. When the elevator door is closed the bar 12 is rotated about its longitudinal axis to cause the arms 20 and 30 to be free from contacting the sill 18 when the elevator car moves in either direction.

The mechanism 10 is coupled to latch mechanism 40 which is mounted on the elevator car. The mechanism 40 includes a bracket 42 having two spaced apart parallel arms 44 and 46 which are provided with aligned apertures 48 and 50, respectively. A cable or rod 52 connected to the elevator car safety 54 is adapted to pass through the aperture 48. It will be noted that the aperture 48 in the arm 44 is larger in diameter than the aperture 50. A stop 56, in the shape of a sphere, for example, is secured to the cable 52 and able to traverse the aperture 48.

A helical compression spring 58 is disposed to surround the cable 52 in the space between the arms 44 and 46. The lower terminus of the spring 58 rests on the arm 46 surrounding the aperture 50. The opposite end of the spring 58 is normally caused to urge against the underside of a reciprocally mounted latch member 60.

The latch member 60 is connected to the pivotally mounted arms 20 and 30 through brake-type cables 62 and 64 which include an outer sheath and associated inner reciprocating inner wires. The inner wire of the cable 62 interconnects the latch 60 with the pivotal arm 20; while the inner wire of the cable 64 interconnects the latch 60 with the pivot arm 30.

In operation, when the elevator car door opens, the bar 12 and the associated arms 20 and 30 are caused to be turned to the position illustrated. The arms 20 and 30 generally extend horizontally outwardly from the bar 12, the arm 20 is shown to be several inches above the hoistway sill 18 and the arm 30 is several inches below the hoistway sill 18. In the event the elevator car moves away from the floor, one or the other of the arms 20, 30 would be urged upwardly or downwardly by the hoistway sill 18. Such movement will cause the arms 20, 30 to pivot about its respective pivot 22, 32 causing simultaneous reciprocal movement of the internal wire of the respective cable 62, 64. Regardless of which of the arms 20, 30 is caused to be moved, the latch 60 is retracted allowing the spring 58 to urge the detent 56 and the associated cable 52 to move in the direction of the arrow and simultaneously set the car safety 54 stopping any further movement of the car.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A safety system for selectively restraining movement of an elevator car when stopped at a floor in an elevator hoistway comprising:

an elevator car including door means for providing access to an interior of said car;

a safety for selectively restraining movement of said car;

a rope connected to said safety;

a stop secured to said rope;

a spring means disposed about said rope for acting against said stop;

a latch normally maintaining said spring means under compression; and a latch actuating means mounted on said car for actuating said latch to release said spring means and urge said rope in a direction to actuate said safety and restrain movement of said car.

2. The safety system according to claim 1 wherein said spring means includes a compression spring.

3. The safety system according to claim 2 wherein said compression spring is helical.

4. The safety system according to claim 1 wherein when said latch releases said spring means, said spring means urges said stop and said rope in the direction to actuate said safety.

5. The safety system according to claim 4 wherein said spring means contacts said stop when released.

6. The safety system according to claim 1 wherein said latch actuating means includes means for determining relative movement between said elevator car and the elevator hoistway.

7. The safety system according to claim 6 wherein said means for determining relative movement includes a pivotally mounted arm.

8. The safety system according to claim 7 including means for connecting said arm to said latch.

9. A safety system for selectively restraining movement of an elevator car when stopped at a floor in an elevator hoistway comprising:

a safety for selectively restraining movement of the car;

a rope connected to said safety;

a stop secured to said rope;

a spring means disposed about said rope for acting against said stop;

a latch normally maintaining said spring means under compression and spaced from said stop; and a latch actuating means mounted on the car for actuating said latch to release said spring means and urge said rope in a direction to actuate said safety and restrain movement of the car in the hoistway.

10. The safety system according to claim 9 wherein when said latch releases said spring means, said spring means urges said stop and said rope in the direction to actuate said safety.

11. The safety system according to claim 9 wherein said latch actuating means includes means for determining relative movement between the car and the hoistway.

12. The safety system according to claim 11 wherein said means for determining relative movement includes a pair of pivotally mounted arms extending on opposite sides of a hoistway sill when the car is adjacent the sill, one of said arms contacting the sill during movement of the car relative to the sill.

13. The safety system according to claim 4 including a pair of cables each connecting an associated one of said arms to said latch.

* * * * *